US006852903B1

(12) United States Patent
Brown et al.

(10) Patent No.: US 6,852,903 B1
(45) Date of Patent: Feb. 8, 2005

(54) DECONTAMINATION OF CHEMICAL WARFARE AGENTS USING A REACTIVE SORBENT

(75) Inventors: Roy S. Brown, Worthington, OH (US); Joseph A. Rossin, Columbus, OH (US); James E. Kotary, Columbus, OH (US); Gyleen Fitzgerald, Churchville, MD (US); Karl G. Gerhart, Aberdeen, MD (US); Helen A. Mearns, Fallston, MD (US); Richard A. Newton, Reisterstown, MD (US); Joseph H. Keller, West Chester, PA (US); Douglas B. Mawhinney, Ithaca, NY (US); John T. Yates, Jr., Allison Park, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 269 days.

(21) Appl. No.: 10/162,055

(22) Filed: Jun. 4, 2002

Related U.S. Application Data

(62) Division of application No. 09/583,457, filed on May 31, 2000, now abandoned.

(51) Int. Cl.[7] ..... A62D 3/00

(52) U.S. Cl. ..... 588/200; 588/205; 588/215; 588/221; 502/417

(58) Field of Search ..... 588/1, 15, 20, 588/200, 203, 205, 221, 215, 218, 224, 236, 242, 246, 249, 251; 502/414, 415, 416, 417, 180, 238, 300, 327, 341, 355

(56) References Cited

U.S. PATENT DOCUMENTS

| | | | | | |
|---|---|---|---|---|---|
| 4,277,346 | A | * | 7/1981 | Sakotani et al. | 210/691 |
| 4,382,879 | A | * | 5/1983 | Funabashi et al. | 502/407 |
| 4,659,512 | A | * | 4/1987 | Macedo et al. | 588/11 |
| 5,689,038 | A | | 11/1997 | Bartram et al. | |
| 6,100,440 | A | * | 8/2000 | Tumiatti et al. | 588/205 |

FOREIGN PATENT DOCUMENTS

| | | | | | |
|---|---|---|---|---|---|
| EP | 589781 | A1 | * | 3/1994 | G21F/9/00 |
| EP | 629437 | A1 | * | 12/1994 | B01J/20/20 |
| FR | 2656949 | A | * | 7/1991 | G21F/9/30 |
| JP | 55049140 | A | * | 4/1980 | B01J/20/00 |
| WO | WO 9414504 | A1 | * | 7/1994 | A62D/3/00 |

OTHER PUBLICATIONS

Mawhinney et al., J. Am. Chem. Soc. (1999), vol. 15, #14, 4789–4795.

* cited by examiner

*Primary Examiner*—Stuart L. Hendrickson
*Assistant Examiner*—Peter J Lish
(74) *Attorney, Agent, or Firm*—Ulysses John Biffoni

(57) ABSTRACT

The invention provides reactive sorbents and methods of making and using the same in order to decontaminate surfaces contaminated with toxic agents, such as chemical warfare agents and/or industrial toxins. The reactive sorbents are of two general types, one of which comprises dehydroxylated aluminum oxide and the other comprises porous carbon impregnated with a reactive solution, so that both sorbents take up and then detoxify toxic agents.

15 Claims, No Drawings

DECONTAMINATION OF CHEMICAL WARFARE AGENTS USING A REACTIVE SORBENT

This application is a division of application Ser. No. 09/583,457, filed May 31, 2000 now abandoned.

U.S. GOVERNMENT INTEREST

The invention described herein may be manufactured, used and licensed by or for the U.S. Government for U.S. Government Purposes.

FIELD OF THE INVENTION

This invention relates to reactive sorbents and methods of making and using the same for the decontamination of surfaces contaminated with highly toxic agents, including chemicals warfare ("CW") agents and/or industrial chemicals, insecticides, and the like. More particularly, the invention relates to improvement of surface decontamination processes and reagents by the development of novel sorbents and sorbent preparation methods, including compositions comprising dehydroxylated aluminum oxides, and/or compositions comprising high porosity carbon impregnated with a reactive solution.

BACKGROUND OF THE INVENTION

Exposure to toxic agents, and especially CW agents, and related toxins, is a potential hazard to the armed forces and to civilian populations, since CW agents are stockpiled by several nations, and other nations and groups actively seek to acquire these materials. Some commonly known CW agents are bis-(2-chloroethyl) sulfide (HD or mustard gas), pinacolyl methylphosphonothiolate (GD) and 0-ethyl S-(2-diisopropylamino)ethyl methylphosphonothiolate (VX), as well as analogs and derivatives of these agents. These CW agents are generally delivered as fine aerosol mists which, aside from presenting an inhalation threat, will deposit on surfaces of military equipment and hardware, including uniforms, weapons, vehicles, vans and shelters. Once such equipment and hardware is contaminated with one of the previously mentioned highly toxic agents, the agent must be removed in order to minimize contact hazards.

For this reason, there is an acute need to develop and improve technology for decontamination of highly toxic materials. This is especially true for the class of toxic agents known as nerve agents or nerve gases which are produced and stockpiled for both industrial use and as CW agents. Simply by way of example, one class of nerve agents with a high level of potential lethality is the class that includes organophosphorus-based ("OP") compounds, such as Sarin, Soman, and VX. Such agents can be absorbed through inhalation and/or through the skin of an animal or person. The organophosphorus-type ("OP") CW materials typically manifest their lethal effects against animals and people by inhibiting acetylcholine esterase ("AChE") enzyme at neuromuscular junctions between nerve endings and muscle tissue to produce an excessive buildup of the neurotransmitter acetylcholine, in an animal or person. This can result in paralysis and death in a short time.

In addition to the concerns about CW agents, there is also a growing need in industry for decontamination of industrial chemicals and/or insecticides, for example, ACHE-inhibiting pesticides such as parathion, paraoxon and malathion, among others. Thus, it is very important to be able to effectively detoxify a broad spectrum of toxic agents, including, but not limited to, organophosphorus-type compounds, from contaminated surfaces and sensitive equipment.

CW agents and related toxins are so hazardous that simulants have been developed for purposes of screening decontamination and control methods. These simulants are 2-chloroethylphenyl sulfide (CEPS), an HD simulant, dimethyl methyl phosphonate (DMMP), a G-agent simulant, and diphenylphosphonothioate (DPPT), a VX simulant.

Currently, the U.S. Army uses a nerve agent decontamination solution, DS2, which is composed (by weight) of 2% NaOH, 28% ethylene glycol monomethyl ether, and 70% diethylenetriamine (Richardson, G. A. "Development of a package decontamination system," EACR-1 310-17, U.S. Army Edgewood Arsenal Contract Report (1972), incorporated by reference herein). Although this decontamination solution is effective against OP nerve agents, it is quite toxic, flammable, highly corrosive, and releases toxic by-products into the environment. For example, a component of DS2, namely methyl cellosolve, is a teratogen, so that the manufacture and use of DS2 also presents a potential health risk. DS2 protocol calls for waiting 30 minutes after DS2 application, then rinsing the treated area with water in order to complete the decontamination operation. The need to haul water to a site decontaminated by, DS2 is a further disadvantage for the use of DS2. Thus, there remains a need for an alternative decontamination technology that is both effective and non-hazardous to personnel, sensitive equipment, and/or the environment.

One decontamination material used as an alternative to DS2 is XE555 resin (Ambergard™ Rohm & Haas Company, Philadelphia, Pa.). XE555 is presently being used by the military for immediate decontamination applications. The objective of immediate decontamination operations is to remove toxic agents from the contaminated surface as rapidly as possible. However, XE555 has several disadvantages. Although effective at removing chemical agents, XE555 does not possesses sufficient reactive properties to neutralize the toxic agent(s) picked up by this resin. Thus, after use for decontamination purposes, XE555 itself presents an ongoing threat from off-gassing toxins and/or vapors mixed with the resin. In addition, XE555 is relatively expensive in the quantities required for decontamination purposes.

Bartram and Wagner (U.S. Pat. No. 5,689,038, incorporated by reference herein) report the use of an aluminum oxide and a mixture of aluminum oxide and magnesium monoperoxyphthalate (MMPP) to decontaminate surfaces contacted with droplets of CW agents.

This patent reports that both materials were able to effectively remove such toxic agents from a surface to the same extent as XE555. In addition, both materials represented improvements in CW agent degrading reactivity and in reducing off-gassing of toxins relative to XE555. However, it should be appreciated that the sorbents described by Bartram and Wagner were based on an activated aluminum oxide. Activated aluminum oxide is distinguishable from other forms of aluminum oxide in that it is a highly porous granular form of aluminum oxide which has a preferential capacity to adsorb moisture from gases, vapors or liquids. However, the Bartram and Wagner patent fails to describe methods to chemically optimize the aluminum oxide. Instead, the reported sorbents were based on pre-existing, commercially available materials, such as Selexsorb CD™, a product of the Alcoa Company. Essentially, Bartram and Wagner reported that their aluminum oxide is modified by size reduction, grinding or milling.

Thus, there remains a need in the art for even more effective, chemically modified forms of aluminum oxide, and for still further compositions and methods, to allow for the rapid and effective removal and/or decontamination of CW agents and related highly toxic materials in an environmentally acceptable and cost-effective process.

SUMMARY OF THE INVENTION

In order to solve these and other problems in the art, the present invention provides the novel compositions suitable for use as "reactive sorbents" and methods for preparing and using these novel reactive sorbents to decontaminate a wide range of highly toxic materials. The reactive sorbents of the invention are, for example, based on either a dehydroxylated, porous aluminum oxide and/or an activated, porous carbon.

In a first embodiment, the invention broadly provides a composition of dehydroxylated aluminum oxide and a reagent such as, e.g., an alkali metal, a base metal, lanthanide metal and/or combinations thereof. The metal is, simply by way of example, sodium, lithium, cesium, magnesium, calcium, zirconium, cerium, lanthanum, iron, zinc, silicon and/or combinations thereof. The metal is provided in a form of, e.g., a carbonate, a nitrate, an oxide and/or combinations of these.

The reagent is present, e.g., in a proportion ranging from about 0.1 weight percent to about 50 weight percent, and in more particular embodiments is present, e.g., in a proportion ranging from about 0.1 weight percent to about 0.20 weight percent. In another embodiment of the invention, the reactive sorbent for decontamination of organophosphorus-type toxic agents includes a composition of a porous carbon and a reactive solution. The reactive solution includes, e.g., a reagent such as an organic amine, an organic imine, an alcohol, an alkoxide, and/or combinations thereof. In particular, the carbon-based reactive sorbent also includes, e.g., a reagent such as an organic imine polyethyleneimine, a, diethylenetriamine, a triethylenediamine, an alcohol that is a $C_1$–$C_6$ alkyl derivative, sodium methoxide, sodium ethoxide and/or combinations thereof.

The porous carbon is any carbon form that is effective to trap and hold the toxic agent(s) to be decontaminated. These include, for example, a reactive sorbent that includes a porous carbon having a surface area ranging from about 400 $m^2/g$ to about 1900 $m^2/g$., and/dr a pore volume ranging from about 0.4 $cm^3/g$ to about 1.8 $cm^3/g$. Further, the porous carbon has, for example, from about 10 to about 90% of its pore volume filled with the reactive solution.

The invention further provides for methods of making reactive sorbents. For example, an aluminum oxide-based reactive sorbent is prepared by:

(a) mixing aluminum oxide powder with a composition that includes at least one metal, in a weight proportion ranging from about 0.1 to about 50 percent by weight, and (b) heating the resulting mixture for a time and at a temperature effective to dehydroxylate the aluminum oxide powder, to produce a reactive aluminum oxide sorbent.

In yet a further aspect of the invention, the aluminum oxide powder is preferably p-boehmite alumina, and the process further includes (a) slurrying the p-boehmite alumina with distilled or deionized water, and then mixing the slurry with the composition comprising at least one metal, acidifying the slurry to a pH ranging from about 3.3 to about 3.5 to form a gel, (b) mixing the gel for a time ranging from about 30 minutes to about 8 hours, (c) drying the gel, and (d) dehydroxylating or activating the aluminum oxide by heating to about 1000 degrees F. for at least 2.5 hours.

In a still further embodiment, the sorbent is carbon-based and manufactured by:

(a) impregnating a porous carbon powder with a reactive solution, in a carbon to solution weight proportion of about 100 parts carbon, to a range of about 80 to about 120 parts reactive solution, wherein the reactive solution comprises a reagent selected from the group consisting of organic amine, an organic imine, an alcohol, an alkoxide, and combinations thereof, dissolved in a carrier solvent, and (b) evaporating a portion of the carrier solvent until the impregnated carbon is a free-flowing powder.

The reagent is preferably one of the following: an organic imine polyethyleneimine, a diethylenetriamine, triethylenediamine, an alcohol that is a $C_1$–$C_6$ alkyl derivative, a sodium, methoxide, sodium ethoxide and/or combinations thereof.

Decontamination methods are also provided. For example, one method of decontaminating a surface believed to comprise a toxic agent includes the following steps:

contacting the contaminated surface with a reactive sorbent, e.g. a dehydroxylated aluminum oxide and/or a carbon based reactive sorbent as described supra for a time period effective to remove substantially all of a potential toxic contaminant, and to decontaminate a substantial proportion of the absorbed contaminant.

DETAILED DESCRIPTION OF THE PREFERRED EMBODIMENTS

Accordingly, the invention provides novel compositions for removing and deactivating a wide range of highly toxic materials, including CW agents. In order to appreciate the scope of the invention, the terms "toxin," "toxic agent," and "toxic material," are intended to be equivalent, unless expressly stated to the contrary. In addition, the terms, "nerve gas," "nerve agent," "neurotoxic," and the like are intended to be equivalent, and to refer to a toxin that acts or manifests toxicity, at least in part, by disabling a component of an animal nervous system, e.g., ACHE inhibitors, as discussed supra.

In addition, the use of a term in the singular is intended to encompass its plural in the appropriate context, unless otherwise stated. In addition, reference herein to a toxic agent is intended to encompass CW agents, including, e.g., toxic organophosphorus-type agents, mustard gas and derivatives, and similar such art-known toxins. In addition, unless otherwise stated, the term toxic agent as used herein is also intended to include toxic industrial chemicals, including, but not limited to, organophosphorus-type insecticides, and the like.

Broadly, the novel compositions provided by the invention are reactive sorbents effective for removing, and then deactivating, toxic agents, as defined, supra. Reactive sorbents according to the invention include compositions that absorb, or take up toxic agents, and then deactivate a portion of the taken up toxic agent. Thus, the combination of the sorbent and toxic agent is rendered relatively safer to handle after a period of time, relative to the combination of the same amount of toxin under the same conditions with an otherwise equivalent sorbent lacking reactive properties.

In particular, the reactive sorbents of the invention include dehydroxylated aluminum oxides, optionally combined with reactive catalysts, and/or porous carbon compositions impregnated with a reactive solution, which both take up and at least partially deactivate toxic agents. The novel reactive sorbent compositions provided by the invention can also optionally be used in combination, either sequentially, and/or as a combined mixture.

A. Compositions or Dehydroxylated Aluminum Oxides

In one preferred embodiment, the invention provides for dehydroxylated aluminum oxide, or preferably, compositions of dehydroxylated aluminum oxide that include one or more reagents, e.g., metal-based reagents, and/or binding or reaction promoters, as well as methods of making and using the same, e.g., for toxic agent decontamination.

"Dehydroxylation" refers to a process wherein aluminum oxide is heated to an elevated temperature, typically between 300 and 700° C., in order to remove weakly adsorbed, associated hydroxyl groups. Following dehydroxylation, the aluminum oxide surface consists primarily of isolated hydroxyl groups. Infrared analysis (Mawhinney, Rossin, Gerhart and Yates (LANGUIR, THE ACS JOURNAL OF SURFACES AND COLLOIDS, Vol 15(4):4789–4795, Pub. Jun. 4, 1999, incorporated by reference herein) has confirmed that the isolated hydroxyl groups of dehydroxylated aluminum oxide, are the reactive sites responsible for the destruction of chemical agent simulants.

In order for the dehydroxylated aluminum oxide sorbent to be effective in immediate decontamination operations, the sorb ent must be able to both remove a chemical agent from the surface being decontaminated, and then begin decomposing the absorbed chemical agent. This dual action provides the advantage of reducing the risks associated with potential outgassing from the sorbent, and reducing the toxicity of the sorbent for disposal purposes.

This property of decomposing absorbed chemical agents also adds to the utility of the sorbent, in that it can be applied in the field to sensitive areas and equipment, in situations where contamination with CW agents, and similar types of agents is expected or likely. This later situation would include live-agent training or combat situations, decommissioning of stockpiled CW agents, and industrial toxic agents.

Without meaning to be bound by any theory or hypothesis as to how the invention might work, it is believed that dehydroxylation of a high pore volume aluminum oxide, such as gamma-$Al_2O_3$, enhances the useful properties of aluminum oxide in two ways:

(1) the ability of the sorbent to decontaminate a surface by taking up a toxic agent from objects and/or surfaces is enhanced, and (2) the ability of the sorbent to decompose toxic agents taken up by the sorbent is enhanced.

In a further embodiment, the addition of various optional elements and compounds to the sorbent composition further enhance the capacity of the inventive sorbents for surface decontamination and CW agent degrading reactivity. These elements include, for example, alkali, base or lanthanide metals. Preferred elements include, e.g., sodium, lithium, cesium, magnesium, calcium, zirconium, cerium, lanthanum, iron, zinc, silicon and/or combinations thereof, in the form of, for instance, carbonate, nitrate, or oxide, separately or in combination. More preferably, zinc, sodium and silicon are employed, and even more preferably, sodium and silicon are employed.

Optionally, the above-mentioned metals can be added to the aluminum oxide by impregnation of product aluminum and/or by addition to an aluminum oxide prepared as a gel composition.

A still further embodiment of the invention provides for preparation of an aluminum oxide sorbent powder from a gel of a hydrated aluminum hydroxide (pseudoboehmite).

In yet a still further embodiment, the invention provides for an aluminum oxide sorbent in the form of a thixotrophic fluid. A thixotrophic fluid is a non-Newtonian fluid wherein viscosity is a time dependent function of the shear applied by agitation. Preparation of the sorbent as a thixotrophic fluid is advantageous, because in this form additional elements and compounds are readily incorporated into the sorbent to further enhance efficacy and reactivity. Broadly, and simply by way of example, the thixotrophic aluminum oxide sorbent is prepared, by forming a slurry of hydrated aluminum hydroxide in water, while adjusting the pH of the slurry with an amount of an acid, effective to form a thixotrophic fluid.

Preferably, the acid is gradually added, with mixing, to the aluminum oxide slurry, until a thixotrophic-fluid inducing pH end-point is reached. The acid is optionally a mineral or organic acid, e.g., nitric acid, sulfuric acid, phosphoric acid, acetic acid, or formic acid, and/or combinations thereof. Preferably, nitric acid is employed. The acid is added until the slurry reaches a pH endpoint ranging, for example, from a pH of about 2.0 to a pH of about 5.0. In a preferred embodiment, the acid is added to the slurry until a pH of about 3.3 is reached.

This method of forming a thixotrophic aluminum oxide sorbent also includes the activation of the slurry product to a stable gamma-aluminum oxide phase by heat. Preferably, the slurry is activated by heating to a temperature ranging from about 900° F. and about 1,600° F. More preferably, the activation temperature is about 1,000° F.

The activation by heating is accompanied by drying of the slurry. Thereafter, the composition particle size is mechanically reduced (as a powder) to less than about 325 mesh. Alternately, the slurry is optionally spray dried to produce a powder, that when activated by the same temperature scheme as set forth above, will have a particle size of less than about 325 mesh.

During the heating/activating process, additional elements and compounds are optionally included in the crystalline phase. Further, the activated product is then dehydroxylated by heat to remove associated hydroxyl groups from the sorbent surface. Such hydroxyl groups are thought to hinder reactivity. The dehydroxylation step is also conducted to provide greater pore volume and surface area for even greater enhanced sorbent surface decontamination and reactivity.

B. Compositions of Porous Carbon Composition Impregnated with a Reactive Solution The present invention provides an additional type of reactive sorbent, which is a composition that includes porous carbon impregnated with a reactive solution. The reactive solution is comprised of any suitable reactive formulation effective to decontaminate toxic agents, e.g., CW agents and/or other toxic materials absorbed into the porous carbon. For example, the reactive formulation includes, an organic amine or imine, an alcohol, and a sodium alkoxide. Examples of imines include polyethyleneimine diethylenetriamine triethylenediamine etc. Examples of alcohols include a $C_1$–$C_6$ alkyl derivative, e.g., methanol, ethanol, propanol, isopropanol, etc. Examples of sodium alkoxides include sodium methoxide, sodium ethoxide, etc. Alternatively, sodium alkoxides are prepared by combining an appropriate sodium source, such as sodium hydroxide or sodium metal, with a desired alcohol or glycol, such as methanol, polyethylene glycol, etc. Impregnation of the carbon with the solution is accomplished using techniques well known to the art, such as incipient wetness, spraying, dipping, etc.

Broadly, any suitable porous and/or activated carbon can be employed in preparing the impregnated reactive sorbents of the invention. To be effective, the porous carbon must have, simply by way of example, a surface area of at least 400 $m^2/g$ and a pore volume of at least 0.4 $cm^3/g$, with a preferred surface area of at least 800 $m^2/g$ and a preferred pore volume of at least 0.8 $cm^3/g$. More preferably, the porous carbon has a pore surface area of about 1900 $m^2/g$, or more, and a pore volume of about 1.8 $cm^3/g$, or more. Most preferably, the porous carbon has a pore surface area of about 1800 $m^2/g$ and a pore volume of about 1.75 $cm^3/g$.

Porous carbons useful for preparing the compositions of the invention include, for example, those commercially available from NORIT Americas Inc. (Marshall, Tex.), as Norit™ grades KBFF and KBB, as well as those available from Westvaco, Inc. as 551 type carbons, to name but a few.

The Reactive Solution

As mentioned supra, the reactive solution is prepared by combining an organic imine or an organic amine with an alkoxide in an alcohol solvent. Of the alkoxides, only sodium methoxide is available commercially in bulk quantities. Other alkoxides can be prepared by combining an alcohol or glycol with sodium hydroxide or sodium metal, with sodium metal being the preferred source.

The reactive solution is prepared, for example, by adding the organic imine or amine to an appropriately sized mixing vessel under purge in an inert atmosphere (e.g., dry $N_2$). Examples of organic imines and amines include, but are not limited to, diethylamine, diethylenetriamine, polyethyleneimine, pyridine, triethylamine, triethylenediamine, and the like. Diethylenetriamine is the preferred source, and polyethyleneimine is even more preferred.

To the organic imine or amine is added the alkoxide dissolved in an alcohol or glycol solvent. Examples of alkoxides include sodium methoxide, sodium ethoxide, etc., with sodium methoxide being the preferred source. Examples of alcohols include methanol, ethanol, isopropanol, etc. with methanol being the preferred source. Once blended, the solution is placed in a sealed jar, or other container, until needed.

Impregnating Carbon with the Reactive Solution

The carbon is impregnated with the reactive solution by placing dry carbon (dry to less than 0.5% water) in a mixing vessel. Depending on the scale, the mixing vessel can consist, e.g., of a rotary evaporator, cone blender, ribbon mixer, "V" blender, etc., or any device or technique suitable for contacting liquids and solids. While the actual amounts will vary in proportion to the desired scale of manufacture. Thus, each 100 g of carbon is mixed with about 80 to about 120 g of reactive solution, depending on the porosity of the employed carbon. Once in the vessel, the reactive solution is contacted with the carbon under an inert atmosphere (e.g., dry $N_2$) until 6: incipient wetness is achieved. Alternatively, the carbon can be contacted with the reactive solution by spraying, dripping, etc.

Once the impregnation step is complete, at least a portion of the excess solvent is evaporated. In particular, excess solvent is evaporated from the reactive sorbent such that the resulting carbon has from about 10 to about 90% of the pore volume filled with the reactive solution, and preferably from about 50 to about 75% of the pore volume filled.

C. Testing of Reactive Sorbents

Three performance-related tests were used to evaluate the performance of the novel sorbents described herein. These tests are designed to probe the effectiveness of decontamination, reactivity and any off-gassing or release of incorporated contaminants from the sorbents of the invention by contacting the reactive sorbent of interest with one of the CW agents and/or one of the available simulants. Thus, the ability of the sorbent to absorb a CW agent or simulant was measured, the ability of the CW agent or simulant to deactivate absorbed CW agent or simulant was measured, and the rate at which a sorbent of interest releases a CW agent or simulant as a gas or vapor was also measured. Based on these tests, described in detail in the Examples, infra, it is confirmed that the compositions and methods provided by the invention are effective to absorb and deactivate CW agents and/or simulants of such materials.

D. Application or Reactive Sorbents to Contaminated Surfaces

The methods of the present invention can be carried out by spraying, rubbing, brushing, dipping, dusting, or otherwise contacting the reactive sorbents of the invention with a surface or composition that is believed to be in need of such treatment, e.g., because it is, or might be, contaminated with a toxic agent that the reactive sorbent will remove and/or deactivate.

In one embodiment of the invention, the reactive sorbent is dispersed as a suspension in a suitable carrier. Suitable carriers include polar and nonpolar solvents, e.g., water-based or organic solvent based carriers. Preferably, the carrier is prepared with sufficient viscosity to allow the composition to remain on treated articles or surfaces, for a sufficient time period to remove contaminants.

In another embodiment of the invention, the reactive sorbent is dispersed as a composition that includes the sorbent in the form of a dry powder or dust onto contaminated articles or surfaces.

In yet another embodiment of the invention, the reactive sorbent is dispersed in the form of a granulate formed from a powder or dust form of the composition. Such granulated particles, e.g., pellets, can range in size, for example, from sub-millimeter scale beads or grains, up to granules ranging in size from about 1 to about 4 mm, or greater. These optional larger sizes useful for easy distribution of sufficient quantities of the sorbent for decontaminating surfaces containing standing liquids, such as small pools or puddles of water or other solvent, e.g., including spilled fuel and the like. Depending on the nature of the area or equipment to be decontaminated, the granulate is optionally formulated by art-known methods so as to disperse when contacted by the liquid being treated. In a further embodiment, granules that disperse into a powdered form upon contact with a liquid solvent, further include any art-known thickener or gelling agent, to aid in the immobilization of standing liquids suspected of containing toxic contaminants.

In another preferred embodiment, the granulated form is optionally formulated so as to remain cohesive, while absorbing a liquid suspected of containing toxic agents. Advantageously, the used sorbent in granulate form is readily scooped or shoveled off the treated surface, for further processing or disposal.

The artisan will appreciate that selection of the form in which the inventive composition is dispersed will depend upon the physical form of the contaminant(s), the nature of the terrain and/or equipment or personal needing decontamination, and the practical needs of distribution and removal of the used or spent sorbent.

For purposes of the present invention, it will be understood by those of ordinary skill in the art that the term "sufficient" as used in conjunction with the terms "amount", "time" and "conditions" represents a quantitative value that provides a satisfactory and desired result, i.e., detoxifying toxic agents or decontaminating surfaces which have been in contact with toxic agents. The amounts, conditions and time required to achieve the desired result will, of course, vary somewhat based upon the amount of toxic agent present and the area to be treated. For purposes of illustration, the amount of sorbent required to decontaminate a surface will generally be, at minimum, an amount which is sufficient to cover the affected area surface. As will be readily understood by those of ordinary skill in the art, the time required to achieve satisfactory detoxification or neutralization will be temperature dependent. For example, at 22° C., most VX GD, and H) will be detoxified in about 24 hours. Generally, for purposes of the present invention, the range of time required to achieve neutralization will range from about several minutes to about 24 hours or even greater, if necessary. The conditions required for carrying out the claimed methods can generally be described as ambient environmental conditions. For example, the methods my be used at temperatures ranging from about −30° to about 49° C.

The following examples serve to provide further appreciation of the invention but are not meant in any way to restrict the effective scope of the invention.

EXAMPLE 1

Preparation of Aluminum Oxide

To a 5 gallon container equipped with a high shear disperser was added 12.0 L of deionized (DI) water and 6.0 Kg of p-boehmite alumina, that was mixed to form a slurry. The, slurry pH was adjusted to 3.3 to 3.5 through the addition of a solution of 50% concentrated nitric acid in DI water. The resulting gel was mixed for 12 hours. Following mixing, the gel was covered and allowed to age for 48 hours. Following aging, the resulting gel was dried and activated by being heated to 995° F. for 2 hours. The activated product was reduced to a powder of less than 325 mesh by a series of milling and grinding operations.

The surface area and pore volume of the resulting material was determined to be 247' $m^2/g$ and 0.580 $cm^3/g$, respectively. The resulting material was evaluated for surface decontamination activity or reactivity at −25° F. using the VX simulant DPPT, and the G-agent simulant, DMMP. The produced powder was also evaluated for CW agent degrading reactivity using the HD simulant CEPS, and DPPT at 77(F (5 hours contact).

Surface decontamination properties were measured by depositing 10 mg of chemical agent or chemical agent simulant as 0.5 microliter droplets onto a stainless steel disc (approximately 7.5 cm in diameter) at the desired temperature. 20 mg of the tested reactive sorbent was then dusted onto the surface and rubbed using a stain less steel applicator. The applied reactive sorbent was allowed to remain on the surface for 5 minutes, at which time the disc was brushed free of the reactive sorbent. The disc was then placed in ajar containing a, known amount of solvent. The solvent was then analyzed for the concentration of chemical agent or chemical agent simulant using standard gas chromatographic techniques well known to the art. The results are reported as the percent CW agent and/or simulant removed at the stipulated temperature and duration of contact.

The results of these tests, along with parallel tests performed using Selexsorb™ CD (a commercial aluminum oxide) are shown in Table 1.

TABLE 1

Surface Decontamination of Simulants at −25° F.

| Sorbent | DPPT | DMMP |
|---|---|---|
| $Al_2O_3$ (Example 1) | 96.8% | 95.0% |
| $A_2O_3$ (Selexsorb ™ CD) | 83.9% | 80.4% |

The reactivity of the sorbent was then analyzed by contacting 150 mg of sorbent with 75 mg of chemical agent or chemical agent simulant at the desired temperature. Following a discrete period of time, the chemical agent or chemical agent simulant was extracted from the pores of the reactive sorbent using a known amount of solvent. Following the extraction, the solvent was analyzed for the concentration of chemical agent or chemical agent simulant using standard gas chromatographic techniques. These results were used to determine the percent agent destroyed by the reactive sorbent, and the results are shown in Table 2, below.

TABLE 2

Reactivity of Simulants Absorbed by Sorbent, at 77° F., 5 Hours Contact

| Sorbent | DPPT | CEPS |
|---|---|---|
| $Al_2O_3$ (Example 1) | 25.9% | 13.3% |
| $A_2O_3$ (Selexsorb ™ CD) | 25.0% | 20.0% |

The testing results shown by Tables 1 and 2 confirm that the activated aluminum oxide prepared above has improved CW agent surface decontamination capacity relative to Selexsorb™ CD.

EXAMPLE 2

Preparation of Dehydroxylated $Al_2O_3$

The aluminum oxide prepared in Example 1 was dehydroxylated by heating to approximately 1000° F. for 2.5 hours. The surface area and pore volume of the resulting material was determined to be 244 $m^2/g$ and 0.619 $cm^3/g$, respectively. The resulting material was evaluated for simulant surface decontamination at −25° F. using DPPT and DMMP, and reactivity using CEPS and DPPT at 77° F. (5 hours contact). The result of these tests, conducted by the same methods described in Example 1, supra, are reported below.

TABLE 3

Percent Simulant Removed At −25° F. for Surface Decontamination Test

| Sorbent | DPPT | DMMP |
|---|---|---|
| $Al_2O_3$ (Example 1) | 96.8% | 95.0% |
| Dehydroxylated $Al_2O_3$ (Example 2) | 97.5% | 96.9% |

TABLE 4

| Reactivity of Simulants Absorbed by Sorbent, at 77° F., 5 Hours Contact | | |
|---|---|---|
| Sorbent | DPPT | CEPS |
| $Al_2O_3$ (Example 1) | 25.9% | 13.3% |
| Dehydroxylated $Al_2O_3$ (Example 2) | 30.9% | 20.3% |

These results demonstrate that the dehydroxylation of the aluminum oxide enhances both the surface decontamination ability and rate at which the product aluminum oxide degrades CW agent and/or CW agent simulants.

EXAMPLE 3

Preparation of Dehydroxylated $Al_2O_3$ with Sodium Silicate Pentahydrate

To a 5 gallon container equipped with a high shear disperser was added 10.0 L of DI water and 5.0 Kg of p-boehmite alumina. To the slurry was added 600 g of sodium silicate pentahydrate. The slurry pH was adjusted to 3.3 to 3.5 through the addition of a solution of 50% concentrated nitric acid in DI water. The resulting gel was mixed for 8 hours, then allowed to age for 72 hours at room temperature. Following aging, the resulting gel was dried and activated by being heated to 995° F.

The activated product was reduced to a powder of less than 325 mesh by a series of milling and grinding operations. The powder was then dehydroxylated by being heated to approximately 1000° F. for 2.5 hours. This material will be referred to as AI-NaSi-1.

EXAMPLE 4

Preparation of Dehydroxylated $Al_2O_3$ with Zirconium Oxynitrate

To a 5 gallon container equipped with a high shear disperser was added 12.0 L of DI water and 5.0 kg of p-boehmite alumina. To the slurry was added 2.05 kg of zirconium oxynitrate solution (20% by weight $ZrO_2$). The slurry pH was adjusted to 3.3 to 3.5 through the addition of a solution of 50% concentrated nitric acid in DI water. The resulting gel was mix ed for 8 hours, then allowed to age for 72 hours at room temperature. Following aging, the resulting gel was dried and activated by being heated to 995° F.

The activated product was reduced to a powder of less than 325 mesh by a series of milling and grinding operations. The powder was then dehydroxylated by being heated to approximately 1000° F. for 2.5 hours. This material will be referred to as Al-Zr-I.

EXAMPLE 5

Preparation of Dehydroxylated $Al_2O_3$ with Magnesium Nitrate Hexahydrate

To a 5 gallon container equipped with a high shear disperser was added 10.0 L of DI water and 2.4 kg of magnesium nitrate hexahydrate. 5.0 kg of p-boehmite alumina was then added. The slurry pH was adjusted to 5.1 using a solution of 50% concentrated nitric acid in DI water. The resulting gel was mixed for 30 minutes, then allowed to age for 5 days at room temperature. Following aging, the resulting gel was dried and activated by being heated to 995° F.

The activated product was reduced to a powder of less than 325 mesh by a series of milling and grinding operations. The powder was then dehydroxylated by being heated to approximately 1000° F. for 2.5 hours. This material will be referred to as Al-Mg-1.

EXAMPLE 6

Preparation of Dehydroxylated $Al_2O_3$ with $La_2O_3$

To a 5 gallon container equipped with a high shear disperser was added 10.0 L of DI water and 5.0 kg of p-boehmite alumina. 350 g of lanthanum oxide ($La_2O_3$) was next added as less than 5 micron particles. The slurry pH was adjusted to between 3.3 and 3.5 using a solution of 50% concentrated nitric acid in DI water. The resulting gel was mixed for 30 minutes, then allowed to age for 3 days at room temperature. Following aging, the resulting gel was dried and activated by being heated to 995° F.

The activated product was reduced to a powder of less than 325 mesh by a series of milling and grinding operations. The powder was then dehydroxylated by being heated to approximately 1000° F. for 2.5 hours. This material will be referred to as AI-La-1.

EXAMPLE 7

Preparation of Dehydroxylated $Al_2O_3$ with $CeO_2$

To a 5 gallon container equipped with a high shear disperser was added 10.0 L of DI water and 5.0 kg of p-boehmite alumina. 350 g of cerium oxide ($CeO_2$) was next added, in the form of particles of less than 5 microns. The slurry pH was adjusted to between 3.3 and 3.5 using a solution of 50% concentrated nitric acid in DI water. The resulting gel was mixed for 16 hours, then allowed to age for 3 days at room temperature. Following aging, the resulting gel was dried and activated by being heated to 995° F.

The activated product was reduced to a powder of less than 325 mesh by a series of milling and grinding operations. The powder was then dehydroxylated by being heated to approximately 1000° F. for 2.5 hours. This material will be referred to as Al-Ce-1.

EXAMPLE 8

Preparation of Dehydroxylated $Al_2O_3$ with ZnO

To a 5 gallon container equipped with a high shear disperser was added 10.0 L of DI water and 5.0 kg of p-boehmite alumina. 525 g of zinc oxide (ZnO) was next added as less than 5 micron particles. The slurry pH was adjusted to 5.2 using a solution of 50% concentrated nitric acid in DI water. The resulting gel was mixed for 30 minutes, then allowed to age for 3 days at room temperature. Following aging, the resulting gel was dried and activated by being heated to 995° F.

The activated product was reduced to a powder of less than 325 mesh by a series of milling and grinding operations. The powder was then dehydroxylated by being heated to approximately 1000° F. for 2.5 hours. This material will be referred to as Al-Zn-1.

EXAMPLE 9

Preparation of Dehydroxylated $Al_2O_3$ with Zinc Chloride

To a 1 liter glass beaker was added 550 ml of DI water. 17 g of anhydrous sodium carbonate was then added to the beaker. Once dissolved, 45 g of aluminum oxide powder was added and allowed to stir for 60 minutes. The aluminum oxide powder was prepared according to Example 1, with a particle size of less than 325 mesh. To the resulting mixture was added a zinc solution prepared by dissolving 5 g of zinc (as zinc chloride) in 50 ml DI water, with the zinc solution adjusted to 4.0 using sodium bicarbonate. The aluminum oxide slurry was heated to 65° C. for approximately 25 minutes, with the final temperature maintained for 30 minutes. Following this, the resulting aluminum oxide slurry was cooled to below 35° C., filtered washed, then dried at 110° C. The powder was then dehydroxylated by being heated to approximately 1000° F. for 2.5 hours. This material will be referred to as Al-Zn-2

EXAMPLE 10

Preparation of Dehydroxylated $Al_2O_3$ with Magnesium Chloride

To a 1 liter glass beaker was added 550 ml of DI water. 17 g of anhydrous sodium carbonate was then added. Once dissolved, 45 g of less than 325 mesh aluminum oxide prepared according to Example 1 was added and allowed to stir for 60 minutes. To the resulting mixture was added a magnesium solution prepared by dissolving 5 g of magnesium (as magnesium chloride) in 50 ml DI water, with the magnesium solution adjusted to 4.0 using sodium bicarbonate. The aluminum oxide slurry was heated to 65° C. for approximately 25 minutes, with the final temperature maintained for 30 minutes. Following this, the aluminum oxide slurry was cooled to below 35° C., filtered, washed, then dried at 111° C. The powder was then dehydroxylated by being heated to approximately 100° F. for 2.5 hours. This material will be referred to as Al-Mg-2.

EXAMPLE 11

Preparation of Dehydroxylated $Al_2O_3$ with NaCl

To a 1 liter glass beaker was added 550 ml of DI water. 17 g of anhydrous sodium carbonate was then added. Once dissolved, 45 g of less than 325 mesh aluminum oxide prepared according to Example 1 was added and allowed to stir for 60 minutes. To the resulting mixture was added a sodium solution prepared by dissolving 5 g of sodium (as sodium chloride) in 50 ml DI water, with the sodium solution adjusted to 4.0 using sodium bicarbonate. The aluminum oxide slurry was heated to 65° C. for approximately 25 minutes, with the final temperature maintained for 30 minutes. Following this, the aluminum oxide slurry was cooled to below 35° C., filtered, washed, then dried at 110° C. The powder was then dehydroxylated by being heated to approximately 1000° F. for 2.5 hours. This material will be referred to as Al-Na-1.

EXAMPLE 12

Surface Area And Pore Volume Measurements

Surface area and pore volume measurements were performed using standard $N_2$ BET techniques for materials reported in Examples 1 through 8. These results are presented below. As a reference, results related to Selexsorb™ CD (a commercial aluminum oxide) is also reported.

TABLE 5

$N_2$ BET Surface Area and Pore Volume Measurements

| Sorbent | Example | Surface Area, $m^2/g$ | Pore Volume, $cm^2/g$ |
|---|---|---|---|
| Selexsorb ™ CD | | 327 | 0.265 |
| $Al_2O_3$ | 2 | 244 | 0.619 |
| A-NaSi-1 | 3 | 258 | 0.537 |
| A-Zr-1 | 4 | 211 | 0.423 |

TABLE 5-continued $N_2$ BET Surface Area and Pore Volume Measurements

| Sorbent | Example | Surface Area, $m^2/g$ | Pore Volume, $cm^2/g$ |
|---|---|---|---|
| Al-Mg-1 | 5 | 211 | 0.495 |
| Al-La-1 | 6 | 225 | 0.471 |
| Al-Ce-1 | 7 | 229 | 0.493 |
| Al-Zn-1 | 8 | 232 | 0.564 |

The above tabulated pore-volume data confirm that the dehydroxylation processes of Examples 2–6 provide a substantial increase in pore volume, relative to particle surface area for the treated aluminum oxide compositions.

EXAMPLE 13

Surface Decontamination Properties of Dehydroxylated Aluminum Oxide Sorbents

The ability of the novel reactive sorbents of the invention to remove CW agent and simulants thereof, from a surface was confirmed by removal testing, using the methods described supra in Example 1. In this example, dehydroxylated aluminum oxides prepared in Examples 2 through 6 were tested. As a reference, results related to Selexsorb™ CD (a commercial aluminum oxide) are also reported.

TABLE 6

Percent Simulant Removed at −25° F. For Surface Decontamination Test

| Sorbent | Example | DPPT | DMMP |
|---|---|---|---|
| Selexsorb ™ CD | | 83.9% | 80.4% |
| $Al_2O_3$ | 2 | 97.5% | 96.9% |
| Al-NaSi-1 | 3 | 98.1% | 97.2% |
| Al-Zr-1 | 4 | 97.8% | 95.7% |
| Al-Mg-1 | 5 | 99.4% | 96.9% |
| Al-La-1 | 6 | 97.1% | 96.8% |
| Al-Ce-1 | 7 | 98.5% | 97.3% |
| Al-Zn-1 | 8 | 97.2% | 94.5% |
| Al-Zn-2 | 9 | 97.3% | 96.0% |
| A-lMg-2 | 10 | 98.0% | 96.8% |
| Al-Na-2 | 11 | 97.2% | N/A |

Table 6 confirms a significant and substantial improvement in removal ability for the above-tabulated dehydroxylated aluminum oxides, relative to the Selexsorb™ CD. The approximately 15–25 percent improvement in the quantity removed under the specified conditions is particularly important given the extreme toxicity of CW agents and related toxins.

EXAMPLE 14

Reactivity Properties of Dehydroxylated Aluminum Oxide Sorbents

The ability of the dehydroxylated aluminum oxides prepared in Examples 2 through 6 to destroy chemical agent simulant following 5 hours of contact was confirmed by removal testing, using the methods described supra in Example 1. As a reference, results related to Selexsorb™ CD (a commercial aluminum oxide) are also reported. The data is provided by Table 7, below.

TABLE 7

| Percent Simulant Destroyed Following 5 Hrs Contact at 77° F. | | | |
|---|---|---|---|
| Sorbent | Example | DPPT | CEPS |
| Selexsorb ™ CD | | 25.0% | 20.0% |
| $Al_2O_3$ | 2 | 30.9% | 20.3% |
| Al-NaSi-1 | 3 | 23.4% | 27.2% |
| Al-Zr-1 | 4 | 28.9% | 14.3% |
| Al-Mg-1 | 5 | 13.4% | 24.2% |
| Al-La-1 | 6 | 19.2% | 26.7% |
| Al-Ce-1 | 7 | 21.1% | 17.1% |
| Al-Zn-1 | 8 | 21.2% | 27.7% |
| Al-Zn-2 | 9 | 18.7% | 34.3% |
| Al-Mg-2 | 10 | 18.3% | 31.6% |
| Al-Na-2 | 11 | 27.6% | 33.4% |

EXAMPLE 15

Surface Removal of HD, TGD and VX

The ability of Al-NaSi-1 to decontaminate a surface contaminated with chemical agents HD, TGD (thickened GD) and VX over a range of temperatures was determined using the methods described by Example 1, supra. All tests were performed with 0.5 g agent/g sorbent. Results are provided in Table 8, below and include data corresponding to a commercial aluminum oxide (Selexsorb™ CD) for comparison.

TABLE 8

| Percent Chemical Agent Removed at −25° F. for Surface Decontamination Test | | | |
|---|---|---|---|
| | | Percent Agent Removed | |
| Agent | Temperature | Selexsorb ™ CD | Al-NaSi-1 |
| HD | 77°F. | 99.9% | 99.4% |
| HD | 120°F. | 100.0% | 99.9% |
| TGD | −25°F. | 86.0% | 97.6% |
| TGD | 77°F. | 99.4% | 99.8% |
| TGD | 120°F. | 99.8% | 99.9% |
| VX | −25°F. | 90.8% | 97.1% |
| VX | 77°F. | 89.7% | 96.0% |
| VX | 120°F. | 97.0% | 98.9% |

EXAMPLE 16

CW Agent Reaction Properties of Dehydroxylated Aluminum Oxide Sorbents

The ability of Al-NaSi-1 to destroy chemical agents HD, GD and VX over a range of temperatures following 24 hours of contact is reported below. All tests were performed with 0.5 g agent/g sorbent.

TABLE 9

| Percent Chemical Agent Destroyed Using Al-NaSi-1 following 24 Hours Contact | | |
|---|---|---|
| Agent | Temperature | Percent Agent Destroyed |
| HD | 77°F. | 34.1% |
| HD | 120°F. | 40.3% |
| GD | −25°F. | 7.6% |
| GD | 77°F. | 31.3% |

TABLE 9-continued

| Percent Chemical Agent Destroyed Using Al-NaSi-1 following 24 Hours Contact | | |
|---|---|---|
| Agent | Temperature | Percent Agent Destroyed |
| GD | 120°F. | 78.7% |
| VX | 77°F. | 39.6% |
| VX | 120°F. | 47.6% |

EXAMPLE 17

Preparation of PNP-01-Impregnated KBB-Carbon Sorbent

PNP01 solution was prepared by adding one liter of methanol to a 4 liter high density polypropylene vessel under $N_2$ purge. 145 g of NaOH was then slowly added to the methanol while stirring with a stirring plate under $N_2$ purge. Once the sodium hydroxide was dissolved, 287 g of polyethyleneinime was added and the solution was allowed to stir for 3 hours. Following this, 145 g of polyethylene glycol was added, and the solution was allowed to stir, an additional 3 hours.

Norit™-type KBB carbon (surface area=1800 $m^2/g$, pore volume 1.75 $cm^3/g$) was impregnated with the above solution. 100 g of dry KBB carbon was added to a 1 liter plastic jar. 109 g of the PNP-01 solution was then added dropwise to the KBB carbon while mixing with a spatula. Once complete, 100 g of the resulting material was placed in a drying tower. 500 ml/mm of dry $N_2$ was passed-through the tower until 7 g of methanol was evaporated. The resulting impregnated sorbent will be referred to as KBB-PNP-01.

EXAMPLE 18

Preparation of SMD-01-Impregnated KBB-Carbon Sorbent

SMD-01 solution was prepared by adding 230 g sodium methoxide solution (25 wt. sodium methoxide in methanol) to a one liter high density polypropylene jar under $N_2$ purge. To the solution was added 80 g diethylenetriamine. The resulting solution was stirred for one hour.

Norit™-type KBB carbon (surface area=1800 $m^2/g$, pore volume 1.75 $cm^3/g$) was impregnated with the above solution. 100 g of dry KBB carbon was added to a 1 liter plastic jar. 109 g of the SMD-01 solution was then added dropwise to the KBB carbon while mixing with a spatula. Once complete, 100 g of the resulting material was placed in a drying tower. 500 ml/min of dry $N_2$ was passed through the tower until 7 g of methanol was evaporated. The resulting impregnated sorbent will be referred to as KBB-SMD-01.

EXAMPLE 19

Preparation of SMP-02-Impregnated KBB-Carbon Sorbent

SMP-02 solution was prepared by adding 230 g sodium methoxide solution (25 wt % sodium methoxide in methanol) to a one liter high density polypropylene jar under $N_2$ purge. To the solution was added 60 g polyethyleneimine. The resulting solution was stirred for one hour.

Norit™-type KBB carbon (surface area 1800 $m^2/g$, pore volume=1.75 $cm^3/g$) was impregnated with the above solution. 100 g of dry KBB carbon was added to a 1 liter plastic jar. 109 g of the SMP-02 solution was then added dropwise to the KBB carbon while mixing with a spatula. Once complete, 100 g of the resulting material was placed in a drying tower. 500 ml/min of dry $N_2$ was passed through the tower until 10 g of methanol was evaporated. The resulting impregnated sorbent will be referred to as KBB-SMP-02.

EXAMPLE 20

Preparation of SMD-02-Impregnated KBB-Carbon Sorbent

SMD-02 solution was prepared by adding 148 g sodium methoxide solution (25 wt % sodium methoxide in methanol) to a one liter high density polypropylene jar under $N_2$ purge. To the solution was added 38.6 g diethylenetriamine. The resulting solution was stirred for one hour.

Norit™-type KBB carbon (surface area=1800 $m^2/g$, pore volume=1.75 $cm^3/g$) was impregnated with the above solution. 100 g of dry KBB carbon was added to a 1 liter plastic jar. 109 g of the SMD-02 solution was then added dropwise to the KBB carbon while mixing with a spatula. Once complete, 100 g of the resulting material was placed in a drying tower. 500 ml/min of dry $N_2$ was passed through the tower until 9 g of methanol was evaporated. The resulting impregnated sorbent will be referred to as KBB-SMD-02.

EXAMPLE 21

Preparation of GEND-01-Impregnated KBB Carbon Sorbent

GEND-01 solution was prepared by adding 200 g glycol ether to a one liter high density polypropylene jar under $N_2$ purge. To the solution was added 27.7 g sodium metal in mineral spirits solution (40% sodium metal) and stir overnight. In the morning, add 80 g diethylenetriamine and stir for one hour.

Norit™-type KBB carbon (surface area=1800 $m^2/g$, pore volume=1.75 $cm^3/g$) was impregnated with the above solution. 100 g of dry KBB carbon was added to a 1 liter plastic jar. 109 g of the GEND-01 solution was then added dropwise to the KBB carbon while mixing with a spatula. Once complete, 100 g of the resulting material was placed in a drying tower. 500 ml/min of dry $N_2$ was passed through the tower until 11 g of methanol was evaporated. The resulting impregnated sorbent will be referred to as KBB-GEND-01.

EXAMPLE 22

Preparation of GEND-02-Impregnated KBB-Carbon Sorbent

GEND-02 solution was prepared by adding 200 g glycol ether to a one liter high density polypropylene jar under $N_2$ purge. To the solution was added 10.0 g sodium metal in mineral spirits solution (40% sodium metal) and stir overnight. In the morning, add 80 g diethylenetriamine and stir for one hour.

Norit™-type KBB carbon (surface area=1800 $m^2/g$, pore volume=1.75 $cm^3/g$) was impregnated with the above solution. 100 g of dry KBB carbon was added to a 1 liter plastic jar. 109 g of the GEND-02 solution was then added dropwise to the KBB carbon while mixing with a spatula. Once complete, 100 g of the resulting material was placed in a drying tower. 500 min/ml of dry $N_2$ was passed through the tower until 6 g of methanol was evaporated. The resulting impregnated sorbent will be referred to as KBB-GEND-02.

EXAMPLE 23

Preparation of DNP-02-Impregnated KBB Carbon Sorbent

DNP-02 solution was prepared by adding 250 ml of methanol to a 1 liter high density polypropylene vessel under $N_2$ purge. 35 g of NaOH was then slowly added to the methanol while stirring with a stirring plate under $N_2$ purge. Once the sodium hydroxide was dissolved, 70 g of polyethyleneimine was added and the solution was allowed to stir for 3 hours. Following this, 35 g of polyethylene glycol was added, and the solution was allowed to stir an additional 3 hours.

Norit™-type KBB carbon (surface area=1800 $m^2/g$, pore volume=1.75 $cm^3/g$) was impregnated with the above solution. 100 g of dry KBB carbon was added to a 1 liter plastic jar. 1109 g of the DNP-02 solution was then added dropwise to the KBB carbon while mixing with a spatula. Once complete, 100 g of the resulting material was placed in a drying tower. 500 ml/min of dry $N_2$ was passed through the tower until 18 g of methanol was evaporated. The resulting impregnated sorbent will be referred to as KBB-DNP-02.

EXAMPLE 24

Preparation of PNP-01-Impregnated S51-Carbon Sorbent

Norit™-type S51 carbon (surface area=900 $m^2/g$, pore volume=1.1 $cm^3/g$) was impregnated with the PNP-01 solution as described in Example 17.100 g of dry S51 carbon was added to a 1 liter plastic jar. 60 g of the PNP-01 solution was combined with 60 ml of methanol. 109 g of this solution was then added dropwise to the S51 carbon while mixing with a spatula. Once complete, 100 g of the resulting material was placed in a drying tower. 500 ml/min of dry $N_2$ was passed through the tower until 38 g of methanol was evaporated. The resulting impregnated sorbent will be referred to as S51-PNP-01.

EXAMPLE 25

Preparation of SMP-01-Impregnated S51-Carbon Sorbent

SMP-01 solution was prepared by adding 230 g sodium methoxide solution (25 wt % sodium methoxide in methanol) to a one liter high density polypropylene jar under $N_2$ purge. To the solution was added 80 g polyethyleneimine. The resulting solution was stirred for one hour.

Norit™-type S51 carbon (surface area=900 $m^2/g$, pore volume=1.1 $cm^3/g$) was impregnated with the SP-1 solution as described above. 100 g of dry S51 carbon was added to a 1 liter plastic jar. 90 g of the SMP-I solution was combined with 25 g of methanol. 109 g of this solution was then added dropwise to the S51 carbon while mixing with a spatula. Once complete, 100 g of the resulting material was placed in a drying tower. 500 ml/min of dry $N_2$ was passed through the tower until 29 g of methanol was evaporated. The resulting impregnated sorbent will be referred to as SS1-SMP-01.

EXAMPLE 26

Preparation of SMP-01-Impregnated KBB Carbon Sorbent

The SMP solution described in Example 25 was impregnated into Norit™ KBB carbon using a rotary evaporator. 100 g of dry KBB carbon was placed in a 1 liter flask, which was attached to a rotary evaporator. The system was then flushed with dry $N_2$ for one hour while rotating at 20 RPM's. While purging, 125 ml of the SMP-1 solution was combined with 50 ml of methanol and stirred. Following the $N_2$ purge, the resulting solution was metered into the rotary evaporator at a rate of 10 ml/mm through a dip tube which allowed the solution to drip onto the carbon while rotating. Once addition of solution was complete, the resulting material was mixed under flowing $N_2$ for one hour, at which time the contents of the mixing vessel were heated to 70° C. in order to evaporate excess methanol from the material. Once 50 ml of methanol had been collected in the receiving vessel, the mixing vessel was cooled to room temperature while continuing the $N_2$ purge. Once cool, the resulting impregnated sorbent was transferred to a bottle for storage. This impregnated sorbent will be referred to as KBB-SMP-01R.

EXAMPLE 27

Surface Decontamination Tests with Impregnated Carbons Sorbents

The above-described impregnated carbon sorbents were tested for surface decontamination properties by the same methods given for the testing of aluminum oxide sorbents, in Example 1, supra.

Table 10 reports results of surface decontamination testing for selected novel reactive impregnated carbon sorbents. The tests employed thickened dimethylmethyl phosphonate (t-DMMP) and O,S diphenylphosphonothioate (DPPT). t-DMMP is used as a simulant for chemical agent t-GD. DPPT is used as a simulant for chemical agent VX. The use of these compounds to represent chemical agents is well known in the art. Simulant refers to a compound that has physical properties similar to a chemical agent, but is less toxic. This term is well know to one skilled in the art. All tests were performed as described previously. Percent surface decontamination refers to the percentage of chemical agent simulant removed from the surface.

TABLE 10

Percent surface decontamination for novel reactive sorbents at −25° F.

| Material | DPPT Surface Decontamination % | t-DMMP Surface Decontamination, % |
|---|---|---|
| KBB-PNP-01 | 98.0% | 97.1% |
| S51-PNP-01 | 97.8% | 97.2% |
| S51-SMP-01 | 98.6% | 97.3% |
| KBB-SMP-01R | 98.4% | 98.5% |

EXAMPLE 28

Reactivity Testing of Sorbents

The above-described impregnated carbon sorbents were tested for surface decontamination properties by the same methods given for the testing of dehydroxylated aluminum oxide sorbents, in Example 1, supra.

Table 11 reports results for reactivity testing for selected novel reactive sorbents reported herein using 2-chloroethylphenyl sulfide (CEPS) and O,S diphenylphosphonothioate (DPPT). CEPS is used as a simulant for chemical agent HD. DPPT is used as a simulant for chemical agent VX. The use of these compounds to represent chemical agents is well known to one skilled in the art. Simulant refers to a compound that has physical properties similar to a chemical agent, but is less toxic. This term is well know to one skilled in the art. All tests were performed as described previously. Percent conversion refers to the percentage of chemical agent simulant destroyed by the novel reactive sorbent

TABLE 11

Percent CEPS and DPPT Destroyed by Novel Reactive Sorbents at 77° F.

| Reactive | CEPS Conversion, % | | | DPPT Conversion, % |
|---|---|---|---|---|
| Sorbent | 120 min | 300 min | 120 min | 300 min |
| KBB-PNP-01 | 23.4% | | 67.6% | |
| KBB-SMD-01 | 15.1% | | >99% | |
| KBB-SMP-02 | 28.40% | | 97.5% | |
| KBB-SMD-02 | 15.1% | | 94.1% | |
| KBB-GEND-02 | 6.2% | | 4.6% | |
| KBB-DNP-02 | 16.0% | | 75.0% | |
| S51-SMP-01 | 22.6% | | 74.1% | 79.4% |
| KBB-SMP-01R | 30.0% | 34.6% | >99% | >99% |

EXAMPLE 29

Vapor-Release or Off-Gassing Testing Using Simulant

Determination of the release rates of chemical agent or chemical agent simulant in gas or vapor form was conducted with the impregnated carbon sorbents as follows. 80 g of sorbent, was contacted with 40 g of chemical agent or chemical agent simulant. Once contacted, the reactive sorbent was placed in a test tube equipped with a dip tube and side arm. Air, flowing at 100 ml/min (referenced to 0° C., 1 atm pressure) was delivered to the test cell, where it flowed approximately 1 cm above the reactive sorbent. The air stream exited the test tube through the side arm and was analyzed for the concentration of chemical agent or chemical agent simulant as a function of time over a five hour period. Results were used to calculate, by the Euler method, the percent of agent which off-gassed from the sample.

Table 12 reports results of percent CEPS off-gassed from selected novel reactive sorbent following 5 hours using CEPS. Tests were performed following the procedure described supra at 120° F.

TABLE 12

Percent CEPS Off-Gas for Selected Novel Reactive Sorbents at 120° F.

| Material | % CEPS Off-gas |
|---|---|
| KBB-PNP-01 | 17.1% |
| KBB-SMP-02 | 15.7% |
| S51-PNP-01 | 28.0% |
| KBB-SMP-01R | 10.3% |

EXAMPLE 30

Surface Decontamination Testing for KBB-SMP-01R

Surface decontamination testing was conducted, as described supra in Example XX, with reactive sorbent KBB-SMP-01R. Table 13, below, confirms the surface decontamination activity of KBB-SMP-01R in tests against chemical agents HD, VX and t-GD at 77° F.

TABLE 13

| Percent surface decontamination for KBB-SMP-0IR at 77° F. | | | |
|---|---|---|---|
| Reactive Sorbent | HD Surface Decontamination, % | VX Surface Decontamination, % | t-GD Surface Decontamination, % |
| KBB-SMP-0IR | 99.4% | 94.9% | 99.9% |

EXAMPLE 31

Reactivity Testing for KBB-SMP-01R Impregnated carbon sorbent KBB-SMP-01R was tested for the ability to destroy HD, GD and VX. Table 14 reports the results that confirm that KBB-SMP-01R is particularly effective in destroying absorbed GD and VX gases. Results were recorded following procedures described previously (Example 1) at contact times of 120 and 1440 minutes at 77° F.

TABLE 14

| Percent surface decontamination for KBB-SMP-0IR at 77° F. | | | | | |
|---|---|---|---|---|---|
| HD Conversion, % | | GD Conversion, % | | VX Conversion, % | |
| 120 min | 1440 min | 120 min | 1440 min | 120 min | 1440 min |
| 23.7% | 36.0% | 74.0% | 91.5% | 59.3% | 94.2% |

EXAMPLE 32

Vapor-Release or Off-Gassing Testing Using HD, VX and t-GD

The methods described by Example 29, supra were used to determine the percent of HD, VX and t-GD off-gassed from KBB-SMP-01R, following 5 hours of contact at 77° F. off-gassed from selected novel reactive sorbent following 5 hours of contact at 77° F. The data is shown by Table 15, below.

TABLE 15

| Percent chemical agent off-gassed for KBB-SMP-01R at 77° F. | | |
|---|---|---|
| % HD Off-gas | % t-GD Off-gas | % VX Off-gas |
| 7.5% | 16.5% | 0.2% |

What is claimed is:

1. A method of decontaminating a surface believed to be contaminated with one or more toxic agents, wherein said method comprises:

contact said contaminated surface with a reactive sorbent, wherein said reactive sorbent comprises a composition of a porous carbon and a reactive solution wherein said reactive solution comprises a reagent selected from the group consisting of an organic amine, an organic imine, in alcohol, an alkoxide, and combinations thereof.

2. The method of claim 1, wherein said reactive solution comprises a reagent selected from the group consisting of organic imine polyethyleneimine, diethylenetriamine, triethylenediamine, an alcohol that is a $C_1$–$C_6$ alkyl derivative, sodium methoxide, sodium ethoxide and combinations thereof.

3. The method of claim 1, wherein said reactive sorbent further comprises a mixture of said porous carbon and reactive solution mixed with a composition comprising dehydroxylated aluminum oxide and a reagent selected from the group consisting of an alkali metal, a base metal, a lanthanide metal and combinations thereof.

4. The method of claim 3, wherein said reagent combined with said dehydroxylated aluminum oxide comprises a metal selected from the group consisting of sodium, lithium, cesium, magnesium, calcium, zirconium, cerium, lanthanum, iron, zinc, silicon, and combinations thereof.

5. The method of claim 4, wherein said metal combined with said dehydroxylated aluminum oxide is in a form selected from the group consisting of a carbonate, nitrate, oxide, and a combination thereof.

6. The method of claim 3, wherein said reagent combined with said dehydroxylated aluminum oxide is present in an amount ranging from about 0.1 weight percent to about 50 weight percent.

7. The method of claim 6, wherein said reagent is present in an amount ranging from about 0.1 weight percent to about 0.2 weight percent.

8. The method of claim 1, wherein said porous carbon has a surface area ranging from about 400 $m^2/g$ to about 1900 $m^2/g$.

9. The method of claim 1, wherein said porous carbon has a pore volume ranging from about 0.4 $cm^2/g$ to about 1.8 $cm^3/g$.

10. The method of claim 1, a said porous carbon has from about 10 percent to about 90 percent of the pore volume filled with said reactive solution.

11. The method of claim 1, wherein said toxic agent is an organophosphorus compound.

12. The method of claim 11, wherein the organophosphorus compound is selected from the group consisting of pinacolyl methylphosphonothiolate, 0-ethyl S-(2-diisopropylamino)ethyl methylphosphonothiolate, parathion, paraoxon, malathion, and combinations thereof.

13. The method of claim 1, wherein said toxic agent is a chemical warfare agent.

14. The method of claim 13, wherein said chemical warfare agent is selected from the group consisting of an organophosphorus-type warfare agent and mustard.

15. The method of claim 14, wherein said mustard gas comprises bis-(2-chloroethyl) sulfide.

* * * * *